United States Patent [19]

Okukawa

[11] 4,098,552

[45] Jul. 4, 1978

[54] COPYING MACHINE

[75] Inventor: Yasutoshi Okukawa, Ebina, Japan

[73] Assignee: Rank Xerox, Ltd., London, England

[21] Appl. No.: 786,931

[22] Filed: Apr. 12, 1977

[30] Foreign Application Priority Data

Apr. 23, 1976 [JP] Japan ..... 51-050029[U]

[51] Int. Cl.[2] ..... G03G 15/12; G03G 15/28

[52] U.S. Cl. ..... 355/8; 355/30; 355/69; 362/6

[58] Field of Search ..... 355/8, 30, 67, 69; 362/6

[56] References Cited

U.S. PATENT DOCUMENTS 3,330,180 7/1967 Ferguson et al. ..... 355/30 X 3,689,141 9/1972 Gray ..... 355/8 X 3,779,640 12/1973 Kidd ..... 355/8

*Primary Examiner*—Richard L. Moses

*Attorney, Agent, or Firm*—James J. Ralabate; Clarence A. Green; William A. Henry, II

[57] ABSTRACT

A copying apparatus with a reciprocating platen is disclosed having an improved illumination system. The system includes a regulator that maintains an illumination source at an optimum value by turning the illumination source on during forward scan of the platen and off during reverse movement of the platen. The regulator thereby prevents overheating of the illumination source which would reduce illumination output and thereby interfere with copy quality.

5 Claims, 3 Drawing Figures

COPYING MACHINE

BACKGROUND OF THE INVENTION

The present invention relates to a copying machine of the type in which the surface of an original is irradiated by a fluorescent lamp for exposure, an electrostatic latent image is formed on a light sensitive body, and the thus formed electrostatic latent image is transferred to a copy sheet.

Conventionally, the light output of fluorescent lamps used for exposure varies according to the tube wall temperature.

This is thought to be caused by the fact that the evaporation pressure of mercury sealed in the fluorescent lamp varies in accordance with the temperature change. The light output decreases when the wall temperature is either higher or lower than the optimum value.

Therefore, the tube wall temperature is required to be maintained at the optimum value. However, if the fluorescent lamp is turned on, the tube wall temperature inevitably rises, which makes keeping the tube wall temperature at the optimum value virtually impossible.

When the fluorescent lamp, having a tube wall temperature lower than the optimum value, is turned on, the temperature starts to go up and the light output gradually increases. Thereafter, the tube wall temperature exceeds the optimum value, i. e., an overheated state is attained, and the light output gradually decreases. This condition appears when a number of copies are reproduced from originals.

As the output of the light which is irradiated on the original changes, the amount of exposing light reaching the light sensitive body ultimately changes, which makes it difficult to produce copies of high quality.

One method suggested in the past for overcoming the above deficiency was to obtain predetermined amounts of exposing light by use of a slit or the like when the light output is the greatest value. However, in such a case, the background is stained on the first sheet of copy paper as well as on subsequent copies produced thereafter. Also, an image of low density on the original fails to be reproduced on copy paper at the greatest light output.

Another attempt at overcoming the shortcomings noted above was to heat the fluorescent lamp by means of a heating device or cooling by means of blowing air onto the fluorescent lamp, in order to maintain the tube wall temperatue at a predetermined level, thereby stabilizing the light output thereof. Although it is effective to blow air onto the fluorescent lamp to cool it off, a drawback appears in that relatively large equipment as well as space to install the equipment is required to accomplish the cooling effect.

It is accordingly an object of this invention to obtain optimum illumination during exposure from an illumination means.

Another object of the present invention is to conserve energy in copying machine use.

Another object is to maintain illumination only during exposure.

Another object is to obtain constant illumination from a lamp source during a reproduction process.

A still further object of the invention is to maintain the temperature of an illumination means at an optimum value.

These and other objects of the present invention are obtained by providing a copying machine in which the illumination source for exposure is turned off except when a necessary electrostatic latent image is being formed on the light sensitive body, i. e., when exposure is not required, the illumination means is turned off thereby preventing a rise in temperature and non-stabilization of the light output.

BRIEF DESCRIPTION OF THE DRAWINGS

For a better understanding of the invention as well as other objects and further features thereof, reference is had to the following detailed description of the invention to be used in conjunction with the accompanying drawings, wherein.

DESCRIPTION OF THE PREFERRED EMBODIMENT

Figure 1:
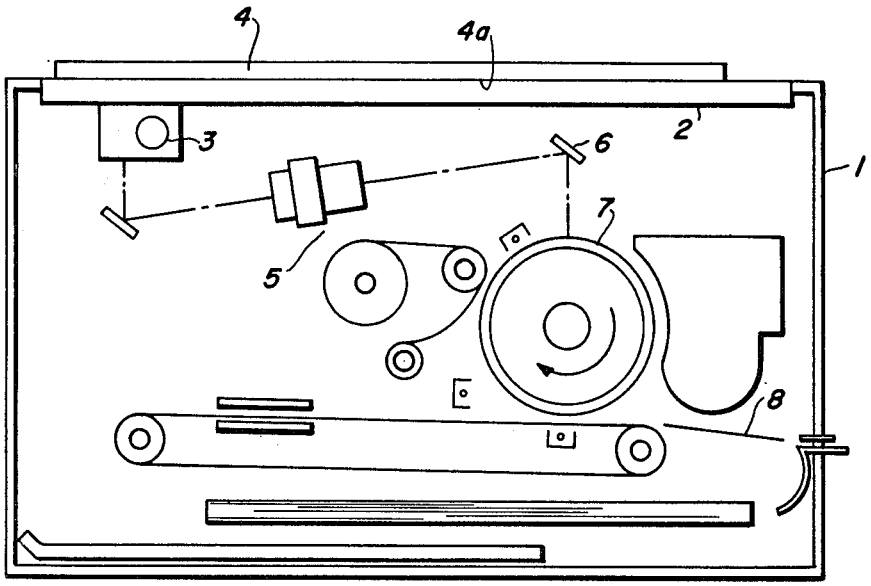
FIG. 1 is a schematic of a copying system employing the present invention.

The present invention can be used in any copier requiring an exposure device. However, for the purpose of exemplary disclosure, the invention will be described within the environment of a xerographic reproduction apparatus. A schematic of such an apparatus is shown in FIG. 1 where a body 1 is provided with a paper rack 2 which is reciprocatively movable on the body. Below the paper rack 2 there is provided a fluorescent lamp for exposure 3 which irradiates or illuminates the surface of an original 4 placed on the paper rack 2, forming an electrostatic latent image on a light sensitive body 7 through a lens 5 and a mirror 6, with the thus formed electrostatic latent image being transferred onto copy paper 8.

Figure 2:
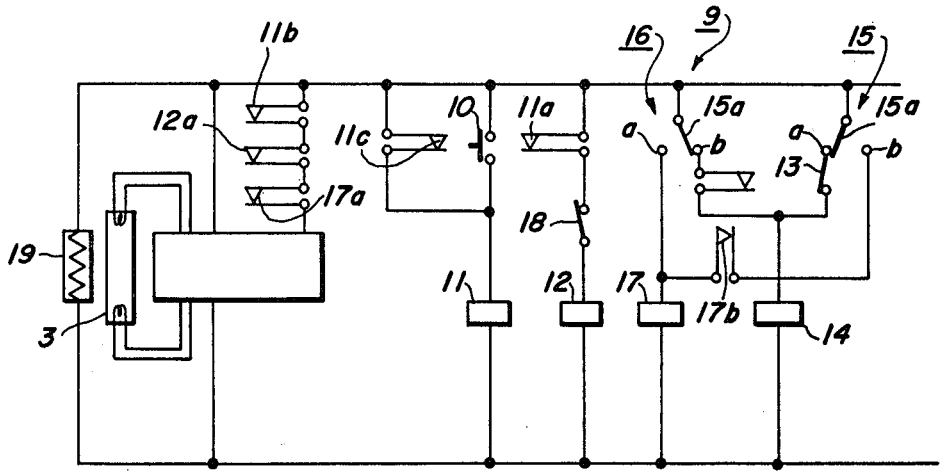
FIG. 2 shows an electric circuit of a fluoroescent lamp used for exposure.

An electric circuit 9 including the aforementioned fluorescent lamp 3 is illustrated in FIG. 2.

When a copying button 10 is switched on, a relay is excited and the connecting point 11*a* is closed, so that a relay 12 is excited and the connecting points 11*b* and 12*a* of each of the relays 11 and 12 are closed, thus turning on the fluorescent lamp 3. The relay 11 is self-sustained at the connecting point 11*c* so that the fluorescent lamp 3 is turned on after the copying button 10 is switched off.

Meanwhile, as soon as the copying button 10 is switched on, a cam switch 13 is turned on, and a relay 14 is excited so that the paper rack 2 is started to move by means of a (conventional) mechanism which is not shown, whereby the contacting portion 15*a* of a switch 15 is shifted from the position *a* to *b*. When the rack 2 reaches the terminal position, a switch 16 is pushed and the connecting copying portion 16*a* thereof is shifted from the position *a* to *b*, so that a relay 17 is excited and the connecting point 17*a* thereof is opened, and as the paper rack 2 returns to the original position, the fluorescent lamp is turned off.

Since the relay 17 is self-sustained at the connecting point 17*b* until the paper rack 2 returns to the original position to turn the switch 15 on, the fluorescent lamp 3 is kept off while the rack is returning to the original position. When the paper rack 2 returns to the original position, the switch 15 is turned on and the connecting portion 15*a* thereof is shifted into the position, *a* so that the relay 17 is demagnetized, and since the connecting point 17*a* is closed again, the fluorescent lamp is turned on.

When a preselected number of copies are obtained after repeating such operation, a switch 18 is turned off at the final returning process of the paper rack and the relay 12 is demagnetized, so that the connecting point 12*a* is opened and the fluorescent lamp 3 remains in the off state until the copying button 10 is switched on again.

Denoted by 19 is a lamp heater, which functions to heat the fluorescent lamp 3 in order to increase the tube wall temperature. Lamp heater 19 is subjected to on-off control so as to maintain the light output of the fluorescent lamp 3 at an optimum or greatest value. As stated above, in the embodiment shown, the fluorescent lamp 3 is adapted to be turned on when the paper rack moves through a forward scan imaging direction and adapted to be turned off when the paper rack 2 moves backward, in a reverse scan non-imaging direction serving to suppress heating the tube wall and prevent a temperature rise and a resultant lowering in the light output of the fluorescent lamp 3, thereby presenting a stable output.

Figure 3:
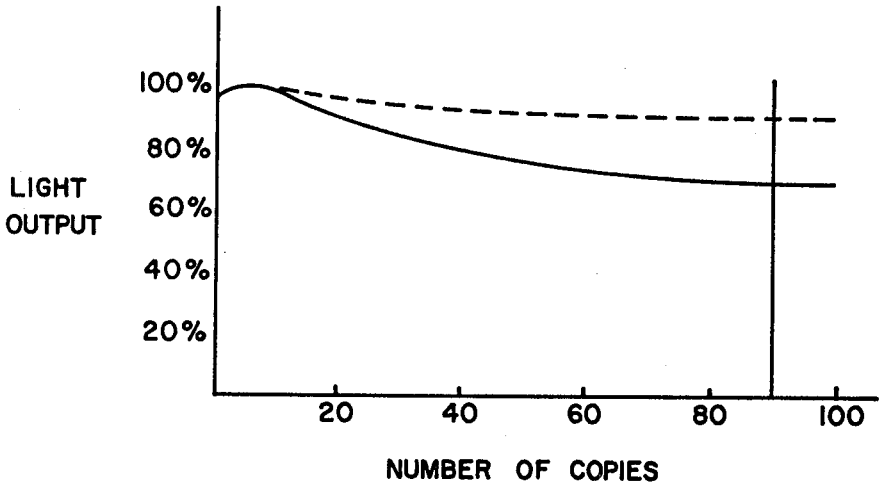
FIG. 3 shows the relationship between the light output and the number of copies reproduced.

This will be clearly seen from FIG. 3, in which is shown by solid line is the relationship between the number of copies successively reproduced and the light output when the fluorescent lamp 3 is turned on while the paper rack 2 moves reciprocatively, indicating that the light output is lowered approximately to 70% of its greatest value after producing 90 sheets or copies. On the other hand, the dotted line shows a relationship between the number of copies successively reproduced and the light output when the fluorescent lamp 3 is turned off on return passes of paper rack 2, indicating that the light output is maintained at a value of 90% of its greatest value even after producing 90 sheets or copies of an original.

As understood from the results as noted above, the lowering in light output can be reduced by turning off the fluorescent lamp 3 when the paper rack 2 returns to the original position.

Although the above-mentioned embodiment describes the copying machine wherein the fluoroescent lamp 3 is adapted to be stationary and the lamp rack 2 is adapted to be reciprocatively movable, it should be understood that the copying machine could be constructed in such a way as to make the paper rack rigid or stationary and the fluorescent lamp and optics movable with the same results being obtained. In summary, it may be enough to turn off the fluoroescent lamp 3 when exposure is unnecessary at each copying cycle.

As is apparent from the foregoing description, according to the invention, the tube wall temperature of the fluoroescent lamp 3 can be prevented from rising with a resultant stabilization of light output with increased copy quality output.

In addition to the apparatus outlined above, any other modifications and/or additions to this invention will be readily apparent to those skilled in the art upon reading this disclosure, and these are intended to be encompassed within the invention disclosed and claimed herein.

What is claimed is:

1. In an electrostatic copying apparatus having a photosensitive member adapted to receive an electrostatic image, a platen and an illumination means for exposing an original document on said platen, the improvement comprising:

regulator means for preventing overheating of said illumination means and stabilizing the light output thereof;

wherein said platen and said illumination means are relatively movable to provide a forward imaging scanning direction and a reverse non-imaging scanning direction; and wherein said regulator means comprises means for turning off said illumination means during movement through said reverse non-imaging scanning direction and turning on said illumination means during movement through said forward imaging scanning direction.

2. The improvement of claim 1 including means for heating said illumination means and means for turning said heating means on during movement through said forward imaging scanning direction and turning off said heating means during movement through said reverse non-imaging scanning direction.

3. The improvement of claim 2 wherein said illumination means is a fluorescent tube.

4. A method of stabilizing light output from an illumination source that exposes an original document in a copying machine having a reciprocating platen that is transported between a forward scan imaging direction and reverse non-imaging scanning direction, comprising the steps of:

a. turning on said illumination source when the platen is moving in said forward scanning imaging direction; and b. turning off said illumination source when said platen is moving in said reverse non-imaging scanning direction.

5. The method of claim 4 including the step of heating said illumination source only during platen movement through said forward scanning imaging direction.

* * * * *